US010227739B2

(12) United States Patent
Laugwitz et al.

(10) Patent No.: US 10,227,739 B2
(45) Date of Patent: Mar. 12, 2019

(54) METHOD FOR DETERMINING A MASS OF MILLED MATERIAL AND GROUND MILLING MACHINE FOR CARRYING OUT SAID METHOD

(71) Applicant: BOMAG GmbH, Boppard (DE)

(72) Inventors: Niels Laugwitz, Lahnstein (DE); Steffen Wachsmann, Koblenz (DE); Maximilian Philippsen, Gingen an der Fils (DE)

(73) Assignee: BOMAG GmbH, Boppard (DE)

( * ) Notice: Subject to any disclaimer, the term of this patent is extended or adjusted under 35 U.S.C. 154(b) by 206 days.

(21) Appl. No.: 14/971,334

(22) Filed: Dec. 16, 2015

(65) Prior Publication Data

US 2016/0177521 A1 Jun. 23, 2016

(30) Foreign Application Priority Data

Dec. 19, 2014 (DE) ..... 10 2014 019 184
Apr. 23, 2015 (DE) ..... 10 2015 005 194

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/127; E01C 23/088
(Continued)

(56) References Cited

U.S. PATENT DOCUMENTS 5,959,257 A * 9/1999 Campbell ..... G01G 11/003 177/119
7,470,082 B2 12/2008 Lloyd
(Continued)

FOREIGN PATENT DOCUMENTS

DE 19951646 A1 5/2001
DE 102008008260 A1 8/2009
(Continued)

OTHER PUBLICATIONS

English language machine translation of Montermann et al., PCT Publication No. WO 01/31301 A1, published May 3, 2001 (9 pages).*
(Continued)

*Primary Examiner* — Janine M Kreck
*Assistant Examiner* — Michael A Goodwin
(74) *Attorney, Agent, or Firm* — Wood Herron & Evans LLP

(57) ABSTRACT

The present invention relates to a method for determining and monitoring the mass of the milled material removed by a ground milling machine, comprising mounting a discharge belt on the ground milling machine via a pivot bearing and a tensile connection in such a manner that it can pivot at least about a horizontal axis, determining a tensile force ($F_z$) exerted by the discharge belt to the tensile connection, calculating a mass flow ($q_m$) of the milled material removed by the ground milling machine from the measured tensile force ($F_z$) and the conveying speed of the discharge belt, and calculating the loaded mass of the milled material removed by the ground milling machine from the mass flow ($q_m$) and the loading time (t). The present invention further relates to a ground milling machine for milling off ground material, in particular a road milling machine, recycler, stabilizer or surface miner, comprising a drive motor, a milling drum
(Continued)

mounted so it is rotatable about a rotational axis in a milling drum box, and a discharge belt for loading milled material, which is mounted on the ground milling machine via a pivot bearing and a tensile connection fixed to the discharge belt such that it can pivot at least about a horizontal axis, the ground milling machine comprising a control device, and the ground milling machine with the control device being configured to carrying out the method according to the present invention.

15 Claims, 4 Drawing Sheets

(58) Field of Classification Search
USPC ..... 198/318, 320, 860.3; 73/862.453, 73/862.392
See application file for complete search history.

(56) References Cited

U.S. PATENT DOCUMENTS

2011/0061762 A1* 3/2011 Madsen ..... A01D 43/087 141/1
2012/0104828 A1* 5/2012 Grathwol ..... E01C 23/088 299/1.5
2013/0080000 A1 3/2013 Von der Lippe et al.
2014/0097665 A1* 4/2014 Paulsen ..... G01B 11/00 299/39.4
2014/0205400 A1 7/2014 von Schonebeck et al.
2016/0053445 A1* 2/2016 Berning ..... E01C 23/01 299/1.5

FOREIGN PATENT DOCUMENTS

DE 102011113752 A1 3/2013
DE 102011114183 A1 3/2013
WO 0131301 A1 5/2001

OTHER PUBLICATIONS

English language machine translation of Von der Lippe, German Patent Publication No. DE 102011113752 A1, published Mar. 21, 2013 (18 pages).*
Espacenet, English Machine Translation of Abstract for DE102011113752A1, published on Mar. 21, 2013 (1 page).

* cited by examiner

METHOD FOR DETERMINING A MASS OF MILLED MATERIAL AND GROUND MILLING MACHINE FOR CARRYING OUT SAID METHOD

CROSS-REFERENCE TO RELATED APPLICATIONS

The present application claims priority under 35 U.S.C. § 119 of German Patent Application No. 10 2014 019 184.2, filed Dec. 19, 2014 and German Patent Application No. 10 2015 005 194.6, filed Apr. 23, 2015, the disclosures of which are hereby incorporated herein by reference in their entireties.

FIELD OF THE INVENTION

The present invention relates to a method for ascertaining and monitoring the mass of the material milled off by a ground milling machine. Moreover, the present invention relates to a ground milling machine for performing such a method.

BACKGROUND OF THE INVENTION

Generic ground milling machines such as road milling machines, recyclers, stabilizers or surface miners are usually used in road or roadway construction or in the extraction of natural resources located near the surface. They regularly comprise a machine frame with travelling means such as wheels or crawler tracks and an operator platform. The working device of a ground milling machine usually includes a milling drum rotatably mounted in a milling drum box and equipped with a plurality of tool devices on its outside jacket surface. A drive motor, usually a diesel engine, drives the ground milling machine, in particular the crawler tracks and the milling drum. During working operation of the ground milling machine, the tool devices of the milling drum are driven into the ground and mill the ground due to its rotation about a horizontal rotation axis. The loosened milled material is conveyed onto a transport vehicle by a conveyor device, which typically comprises a discharge belt and in some ground milling machines also an input belt, and is then transported away by said vehicle. Said discharge belt is frequently a suspension conveyor. Thus, the transport vehicle and the ground milling machine together frequently form a work train, which in most cases consists of a ground milling machine and a transport vehicle travelling either ahead of or behind the ground milling machine, depending on the direction in which the milled material is transported by the ground milling machine for transfer to the transport vehicle. During operation, the ground milling machine moves in its working direction removing ground material along a milling track.

Usually, the amount of milled material is considered as a basis for calculating the remuneration for milling work. Therefore, there is an increased interest in being able to determine the amount of milled material as precisely and reliably as possible. The amount of removed ground material, for example, from roads to be renewed, soil or rock formations, is significantly determined by the length and width of the milling track, the milling depth in which ground material is removed, as well as the properties of the removed ground material per se, such as its density. One possible approach for determining the amount of milled material is thus based on a calculation using the dimensions of the resulting milling bed as described in DE 10 2011 113 752 A1 of the same applicant. However, especially in the case of ground material being composed of materials having various densities, said essentially volumetric determination often leads to a deviation between the calculated mass and the actual mass of milled material. Another option consists in using belt weighers on the conveyors of the ground milling machines as described in U.S. Pat. No. 7,470,082 B2 for a recycler. However, belt weighers have proven to be very inaccurate, particularly when being used on discharge belts, and thus unsuitable for a proper calculation of the milled material, so that there is a demand for reliable alternatives.

In order that the milling work is most cost-effective, it is furthermore important that the transport vehicles for transporting the milled material away are filled up to their maximum capacity if possible in order to prevent unnecessary additional runs. At the same time, the maximum capacity of the individual transport vehicles should not be exceeded in order to not infringe safety regulations on the one hand and to prevent damage to the transport vehicles on the other hand. It is thus also in this regard desirable to achieve a most accurate determination of the mass of the conveyed milled material.

SUMMARY OF THE INVENTION

It is therefore the object of the present invention to provide a method and a ground milling machine which enable a most simple and at the same time sufficiently accurate determination of the mass of the material milled off by the ground milling machine. On the one hand, it should be possible to continuously determine the mass of the milled material in order to be able to monitor the filling of the transport vehicles, and on the other hand simple indication of the mass of the overall milled material during a working operation of the ground milling machine should be enabled. The used measures should be most robust and suitable for being used on a construction site as well as simple and cost-efficient in installation.

Thus, a ground milling machine according to the present invention for milling off ground material, particularly a road milling machine, a recycler, a stabilizer or a surface miner, comprises a drive motor and a milling drum mounted in a milling drum box so as to be rotatable about a rotational axis. In addition, a discharge belt for loading milled material is provided. Said belt is mounted on the ground milling machine via a pivot bearing and a tensile connection fixed to the discharge belt so it is able to pivot at least about a horizontal axis. The pivot bearing is configured such that it enables a rotation of the discharge belt about the horizontal axis. For adjusting the point of discharge of the discharge belt, the angle at which the discharge belt is mounted in the pivot bearing, for example, relative to a virtual horizontal or vertical axis, can be adjusted. By means of a corresponding pivot adjustment, the position of the discharge belt and particularly the position of the discharge point is adjusted both horizontally and vertically. As a result, a discharge height individually adapted to transport vehicles can be set, for example. During operation of the ground milling machine, the discharge belt is maintained in its pivot position by means of a tensile connection between the discharge belt and the ground milling machine. The tensile connection is fixed to both the discharge belt and the ground milling machine. The link of the tensile connection to the ground milling machine is arranged above the pivot bearing particularly in the vertical direction so that the discharge belt exerts a tensile force to the tensile connection due to its own weight. The tensile force to be exerted to the discharge belt by the tensile connection in order to maintain it in its position thus decisively depends on the weight force of the discharge belt. The milled material located on the discharge belt during operation adds to the mass and thus to the weight of the discharge belt.

One aspect of the present invention is to draw a conclusion regarding the mass of the milled material located on the discharge belt from the tensile force required by the tensile connection to maintain the discharge belt in its position. To that end, the ground milling machine according to the present invention further comprises a control device which performs relevant method steps. As a whole, the ground milling machine according to the present invention having the control device for performing the method according to the present invention is configured as described below. The rough values determined by means of the method according to the present invention are sufficient for achieving a sufficiently accurate determination of the mass of the milled material transported away in practice. Specifically, a time component shall also be taken into consideration in the present method in order to be able to use a mass flow measured in [mass/time unit] in the final result, for example, for determining the milling work performed.

The method according to the present invention for determining and monitoring the mass of milled material removed by a ground milling machine over time, or the mass flow, respectively, comprises mounting a discharge belt on the ground milling machine via a pivot bearing and a tensile connection such that the discharge belt is able to pivot at least about a horizontal axis; determining a tensile force which the discharge belt exerts to the tensile connection; calculating a mass flow of the milled material removed by the ground milling machine from the measured tensile force, a conveying length and a conveying speed of the discharge belt; and calculating the transported mass of the milled material removed by the ground milling machine from the mass flow and the loading time. The conveying length of the discharge belt is a reference value with respect to the design of the conveyor belt. Specifically, the conveying length here refers to the length of the conveying distance of the discharge belt as from the point where the milled material is passed onto the belt to the point of discharge, where the milled material is discharged from the discharge belt. Thus, the conveying length is a calculation parameter which may vary depending on the used discharge belt. The mass flow refers to the mass of the milled material conveyed by the discharge belt per time unit, and is indicated in kilogram per second, for example. If the mass flow is multiplied by the loading time or the course of the mass flow is integrated over the loading time, the mass of the milled material loaded during the loading time is obtained.

Usually, the discharge belt of a ground milling machine is not oriented horizontally during operation, but is mounted on the ground milling machine so as to ascend at an inclination by a certain angle away from the ground and the ground milling machine in order to enable a transfer of the milled material to a transport vehicle. At the same time, the tensile connection usually does not act vertically on the discharge belt, but in an inclined manner. It is therefore preferred that the angle at which the discharge belt with its rough longitudinal extension is supported relative to a reference line, for example, a horizontal or vertical straight, on the ground milling machine is also considered when calculating the conveyed mass of the milled material removed by the ground milling machine. It is therefore also preferred that for taking into account various pivoting positions of the discharge belt on the pivot bearing, for example, an angle (hereafter angle $\beta$) between a horizontal straight and a connection line between a mount of the tensile connection on the discharge belt (usually a pivot bearing) and the pivot bearing and/or an angle (hereafter angle $\alpha$) between a vertical straight and a virtual connection line between a mount of the tensile connection on the discharge belt and a link of the tensile connection to the ground milling machine is measured, which is taken into consideration when calculating the mass flow. The above-described straights and connection lines are thus virtual or imaginary lines and straights, which are not necessarily provided as separate components. The essential factor is the position of the starting and end points of these straights and their distance to each other. Both of the aforementioned angles change upon pivoting of the discharge belt about the pivot bearing. The change of the angles is indirectly proportional to one another, so that it is sufficient to determine one of the two angles and calculate the respectively other angle from the current value of the first angle. However, it is also possible to measure both angles and to take them into consideration when calculating the mass of the milled material removed by the ground milling machine. The two angles may particularly also be measured in relation to the direction of the gravitational force as well. Particularly for determining angle $\beta$, 90° may be subtracted from the measured value in this case. By taking the angles into account in the calculation process, the mass of the milled material removed by the ground milling machine can be determined at any angular position of the discharge belt on the pivot bearing, as a result of which the method according to the present invention may be used in any working situation of the ground milling machine. The ways and manners in which said calculation can be performed, for example, will be explained in more detail below.

The tensile force to be exerted to the discharge belt by the tensile connection in order to maintain said belt in its position depends on both the mass of the discharge belt per se and the mass of the milled material located on the discharge belt. Therefore, the portion of the tensile force required for holding the discharge belt per se is to be subtracted from the overall measured tensile force in order to obtain the tensile force required to hold the milled material located on the discharge belt. In other words, the weight of the discharge belt without milled material is to be subtracted from the weight of the discharge belt including the milled material as determined via the tensile force, in order to determine the weight (and thus the mass) of the milled material located on the discharge belt. It is therefore preferred that a tare value is determined for an empty discharge belt, on which basis the mass of the milled material removed by the floor milling machine is calculated. The tare value is the difference between the overall mass of the discharge belt including the milled material located thereon and the mass of the milled material located on the discharge belt. Accordingly, the tare value refers to the mass, respectively the weight force, of the empty discharge belt without milled material and is subtracted from the overall determined mass, respectively the weight force, of the discharge belt with milled material. However, it is also possible to express the tare value already as a portion of the tensile force on the tensile connection, which value is achieved in that the tensile connection is to hold the empty discharge belt as well. Thus, in this case the tare value can be subtracted from the measured tensile force on the tensile connection, so that only the portion of the overall tensile force is considered for calculation which is attributed to the mass of the milled material located on the discharge belt.

The tare value can readily be determined by carrying out the method with an empty discharge belt without simultaneous milling. The tare value can thus be determined prior to each use of the ground milling machine and is thus independent of deviations. An important aspect in this context is that the present method naturally has a systemic inaccurateness since, for example, in the case of a non-homogenous milled material distribution on the discharge belt, for example, at the start and the end of the working operation, the tensile force on the tensile connection is decisively influenced also by the center of mass of the discharge belt including milled material. If a mass X is located on the discharge belt close to the pivot bearing, a different center of mass results compared to when the same mass X is located on the discharge belt close to the point of discharge. However, in practical application it turned out that said inaccurateness is negligible with respect to the overall result to be achieved by the method according to the present invention.

It is decisive for the profitability of the milling process that the transport vehicles, for example, trucks, are loaded in a most complete manner before leaving for transporting off the milled material. A too little loading of the transport vehicles leads to an increased number of transport runs and thus incurs cost. However, overloading the transport vehicles is to be prevented as well, in order to conform to safety regulations and to not damage the transport vehicles. It is therefore advantageous if it is possible to clearly determine the mass of milled material transferred by the ground milling machine to the transport vehicle during operation. It is therefore preferred that the currently determined loaded mass of the milled material removed by the ground milling machine is compared to a maximum loading mass of the transport vehicle and/or a predetermined threshold value during the loading process. For example, the maximum loading mass of the transport vehicle and/or another predetermined threshold value can be input to the control device by an operator via an input device. As an alternative, particularly a wireless information transfer from the transport vehicle to the ground milling machine may be provided as well. This is particularly expedient in cases where various transport vehicles having different loading capacities are used. For example, it may be provided that each transport vehicle has an identification tag which may be read out by a suitable sensor of the ground milling machine. For example, an identification tag according to the present invention may be a QR-code, an RFID chip or a WLAN signal. In the latter cases the input device then comprises a suitable reading device, such as a QR-code reader, etc. According to the present invention, use of any other tags known from the prior art is conceivable. As an alternative, the ground milling machine operator may reset a counter that documents the loaded amount of milled material to zero at the start of the loading to an empty transport vehicle and monitor the loaded amount displayed by the counter. If the capacity of the transport vehicle is reached, the operator stops the loading process. In addition, in particular by considering the currently determined mass flow of the milled material, it may be calculated how long it will take until the transport vehicle currently to be loaded has been completely loaded. This time period can be displayed to the driver of the milling machine either, for example, in the form of a countdown or by another suitable visualization, for example, by a loading progress bar. This makes it easier for him to determine whether he needs another transport vehicle or not.

It is particularly preferred that the comparison is effected automatically and performed by the control device, for example. In order to relieve the operator of the ground milling machine during operation from monitoring the transport vehicle as far as possible, it is therefore further preferred that a loading monitoring function is provided by means of which, for example, when reaching the maximum loading mass of the transport vehicle and/or the predetermined threshold value, an optic and/or acoustic warning signal is output and/or the ground milling machine is influenced, for example, slowed down or even stopped. Stopping the ground milling machine refers to the advancing movement of the ground milling machine during operation and/or the rotation of the milling drum, for example. Due to the automatic loading monitoring function, the operator of the ground milling machine may focus on the milling process and does not need to monitor the loading of the milled material to the transport vehicle in detail. The loading monitoring function may also comprise an indication function, for example, when reaching predetermined threshold values, in particular, for example, "90% of the maximum loading mass reached," etc. An indication to the operator of the ground milling machine may be effected optically, acoustically and/or haptically, for example, in the form of a vibration alarm, via suitable output devices or also by means of a direct interference in the loading and working process, for example, a stop of the milling function, a stop of the machine advance, etc. The operator then receives a warning indication in due time before the maximum allowable loading mass is reached and may request the next transport vehicle or the like, for example.

In order to be able to provide a proof of the work performed, it is further preferred that the method according to the present invention includes a documentation function by means of which the overall mass, the density and/or the volume of the milled material removed by the ground milling machine in a working operation and/or the area milled off in a working operation is determined, displayed and/or stored. For example, the volume may be determined from the milling width (particularly in the case of the entire milling width, namely when the milling drum mills off ground material over its entire width) and the milling depth together with the advance of the ground milling machine. The density of the milled material can be calculated from the volume and the mass, preferably as an average value over a predetermined period of time. Once the density of the milled material in a certain region of the working operation has been determined, the current milling width may be determined as well, for example, from the mass, the volume and the density of the milled material, in particular when the milling depth is known. This works even if the milling drum does not mill off ground material over the entire width, for example, because neighboring milling tracks are partially overlapping. Here, a working operation may, for example, be the loading of a transport vehicle. A working operation could as well consist in milling off a certain area. This means that a working operation may also refer to the use of the ground milling machine at a certain construction site or to the performance of the ground milling machine per day. The operator of the ground milling machine may indicate the start and/or the end of the respective working operation to the control device via an input device. What is important is that it is possible to provide the respective client with a prove of how much milled material has been removed by the ground milling machine after the work has been performed, since this is often times considered the basis for remuneration. Here, the determined overall mass may be displayed either via a display in the ground milling machine or via a printer so that a document for documentation is directly obtained. It is also possible that the determined overall masses are transmitted to a central authority via radio, at which the performance of the ground milling machine may be monitored. The storing of the determined overall mass or further values enables a later read-out and statistical acquisition of the determined values. Likewise, GPS-based systems or the like may be used in this regard.

Conveyors of generic ground milling machines often times comprise an internal input belt. Said input belt transports the milled material removed by the milling drum away from the milling drum box and transfers it to the discharge belt, from which in turn the milled material is loaded to the transport vehicle. Thus, the input belt and the discharge belt are arranged in series. In most cases the input belt is located inside the ground milling machine and is mounted on the machine frame via various supporting points, which is why it is not suitable for performing the method according to the present invention. However, it is in fact as well conceivable to perform the method according to the present invention at the input belt if the input belt is correspondingly mounted like the discharge belt described herein. Since input belts do also have a maximum capacity, particularly in terms of loading volume and loading mass, it is advantageous if the milling performance of the ground milling machine is adjusted such that the capacity of the input belt is used as completely as possible but on the other hand an overload of the input belt is prevented. If the milling performance of the ground milling machine is too high, respectively if the input belt is overloaded, an accumulation of non-transported-off milled material in the milling drum box results, which material is thrown around by the rotating milling drum and besides unnecessary energy consumption leads to wear of the milling drum and the working devices and also of the input belt. In contrast, when falling below the capacity of the conveyor, the input belt runs at an unnecessary speed and is again subject to increased wear. It is therefore preferred that a control of the ground milling machine is performed by a process monitoring function such that depending on the mass of the milled material on the discharge belt, the milling performance of the ground milling machine and/or the speed of the input belt is influenced. If the input belt is overloaded, for example, the milling performance is reduced. Accordingly, the process monitoring function can be used to further optimize the working process and to that end regulate, for example, the advance of the machine and/or the circulation speed of the conveyor such that a maximum milling performance is achieved at minimal wear of the ground milling machine.

In order to relieve the operator of the ground milling machine from additional tasks distracting him from the actual coordination of the milling process, it is preferred that also partial functions of the ground milling machine are automatically controlled by the process monitoring function such that when exceeding the optimum loading mass of the input belt of the conveyor device, the milling performance of the ground milling machine is influenced, for example, reduced. Here, the optimum loading mass of the input belt can either be a specific value of the mass of the milled material or, for example, also be a range of values within which the mass of the milled material located on the input belt should ideally be. Thus, in the optimum range, the loading capacity is reasonably utilized. For example, the milling performance of the ground milling machine may be regulated by the advance of the ground milling machine, namely the travel speed. When reaching the optimum or maximum loading mass of the input belt, for example, the advance of the ground milling machine is reduced, i.e., the ground milling machine advances at a lower speed. In contrast, if it is determined by the measuring on the discharge belt that the input belt is loaded very little, the circulation speed of the input belt may be reduced. Control of the ground milling machine for regulating the milling performance due to a respective exceeding or falling below the optimum loading mass of the input belt is effected automatically by the control device. Without further bothering the operator of the ground milling machine, an optimum and economic operation of the ground milling machine may thus be ensured at any time.

It is another task of the operator of a ground milling machine to take care that the ground milling machine, particularly the discharge belt, does not collide with the transport vehicle, which in most cases travels ahead of or behind the ground milling machine. In this respect, the present invention may be supportive as well. Due to the fact that during operation the tensile force of the tensile connection drops significantly or jumps down, as from a certain level of collision even below the tare value, when the discharge belt is supported on the transport vehicle due to a collision with the transport vehicle, it is possible to detect a collision from such a rapid drop of the tensile force and/or a falling below the tare value. In order to notify the operator of the ground milling machine of such a collision, it is preferred to provide a safety function by means of which an optic and/or acoustic warning signal is output in the case of a drop of the measured tensile force during working operation of the ground milling machine, whereby a collision of the discharge belt with an obstacle, for example, the transport vehicle, is indicated. The drop of the tensile force is outside the range of normal fluctuation usually occurring during operation of the ground milling machine. In fact, this is rather a significant drop of the tensile force, for example, down to the tare value or even below said value. Such a value would mean that there is no milled material on the discharge belt, respectively even that the milled material in the discharge belt has a negative mass. At this point at the latest, a collision of the discharge belt with an obstacle, for example, the transport vehicle, is to be assumed. As an alternative to the output of an optic and/or acoustic warning signal, the advance of the ground milling machine may be stopped as well. This automatic safety function additionally relieves the operator of the ground milling machine.

The object of the present invention is further achieved by means of a ground milling device according to the present invention having the features of the independent claim. Here, an essential part of the ground milling machine according to the present invention lies with the specific configuration of the control device for performing the above described method according to the present invention. Accordingly, the control device is particularly able to detect measuring values, perform calculations and output control commands to further components of the ground milling machine depending on the calculated values.

An essential aspect is that the control device receives a tensile force signal. Thus, according to the present invention the ground milling machine comprises a device configured for detecting the tensile force on the tensile connection between the discharge belt and the ground milling machine. To that end, all options for measuring a force known from the prior art may be considered. For example, it is preferred that the tensile connection comprises a force sensor, in particular a load pin, which is connected to the control device via a signal connection which transmits the tensile force measured by the force sensor. Particularly load pins, also referred to as force measuring bolts or force measuring axes, have proved to be sufficiently robust for the demands in a use according to the present invention. Furthermore, the measuring accuracy of the load pins is sufficient in order to achieve a satisfying calculation of the mass of the milled material removed by the ground milling machine. However, as an alternative, it is also possible to measure the tensile force indirectly. Especially if the tensile connection comprises a hydraulic cylinder, the hydraulic pressure on the hydraulic cylinder may be measured, for example. In this case, the force sensor is a hydraulic pressure sensor. The hydraulic pressure measured by this sensor is proportional to the tensile force on the tensile connection and may be converted into said tensile force. This indirect determination of the tensile force is also expressly included in the scope of the present invention. Preferably, the force sensor is located on the connection point of the tensile connection and the ground milling machine. However, the force sensor may basically be arranged on any other point of the tensile connection between the mount on the discharge belt and the link to the ground milling machine.

For considering various pivoting positions of the discharge belt on the pivot bearing, also the angle at which the discharge belt is supported on the ground milling machine is to be detected and transferred over to the control device. To that end, the ground milling machines according to the present invention thus also comprises a device for determining the pivoting position of the discharge belt about a horizontal pivot bearing axis. This may, for example, be an angle sensor which measures the angle between a reference straight, for example, a horizontal straight, and a reference value at the discharge belt, particularly a virtual connection line between a mount of the tensile connection on the discharge belt and the pivot bearing (angle $\beta$) and/or the angle between a vertical straight and a connection line between a mount of the tensile connection on the discharge belt and a link of the tensile connection to the floor milling machine (angle $\alpha$), particularly in a projection into a plane extending vertically and in working direction, and which sensor is connected to the control device via a signal connection which transmits the angular values measured by the angle sensor. It is also possible to use an angle sensor which measures the corresponding angles relative to the direction of the gravitational force and then calculates the desired angle from said measured value, where required. Since this requires the ground milling machine to be positioned evenly, also an inclination of the ground milling machine may be determined, for example, by means of the positions of the lifting columns, and considered for calculating the angles. For example, the angles may also indirectly be determined via the position of a hydraulic cylinder in the tensile connection between the ground milling machine and the discharge belt. This determination may also take an inclination of the ground milling machine into account. If both angles are to be measured, it is also possible to provide two angle sensors, wherein in each case one angle sensor measures one angle and transmits the respective angle to the control device. However, due to the interdependency of the two angles, it is also possible to determine one angle only and to calculate the second angle from the first angle.

In order to enable the output of warning signals, it is preferred that the control device comprises a warning device configured to output optic and/or acoustic warning signals. The warning device may be a speaker, a display, illumination equipment, for example, an LED, or a combination thereof, for example. It is also advantageous if the warning device is capable of outputting various warning signals depending on various waning situations. Thus, a warning signal may be used to indicate the maximum loading of a transport vehicle, while another warning signal different from the first warning signal is used to indicate a collision of the discharge belt with an obstacle. A third warning signal may be used to indicate a too low or too high load of the discharge belt, for example. This way, confusion can be prevented.

The documentation of the work process can either be effected immediately or continuously and/or be designed for a later evaluation. Basically, any of the values detected by the control device can be displayed and/or stored. In a preferred embodiment, the control device thus comprises a display device and/or a storage device configured to display and/or store the measured tensile force and/or angle and/or the calculated mass and/or the volume and/or the density of the milled material removed by the ground milling machine and/or the milled area, in particular per time unit and/or per work process. However, it is generally sufficient if the calculated mass of the milled material removed by the ground milling machine is displayed and/or stored. This way, the operator has both an overview of the current milling process and it is possible to calculate from the individual values, for example, the daily performance of the ground milling machine at a later time. Further, this type of configuration of the control device may also be used to document the milling process performed.

It is further advantageous if the control device comprises an input device or is at least controlled by an input device. For example, the operator may influence the control of the ground milling machine by means of the control device via said input device. This way, it is possible, for example, that the operator may input via the input device threshold values for comparison with the loaded mass of the milled material removed by the ground milling machine. This way, the operator may input the maximum capacity of the transport vehicle which is currently being loaded with material milled by the ground milling machine. This way, the operator is able to ensure that an over- or underloading of the transport vehicle does not occur. However, as already described, detection of the maximum loading capacity of the transport vehicle currently being loaded by the ground milling machine may also be detected automatically, which further relieves the operator of the ground milling machine.

BRIEF DESCRIPTION OF THE DRAWINGS

The present invention will be described in greater detail below with reference to the exemplary embodiments shown in the drawings. In the schematic figures.

In the figures, like components are designated by like reference numerals. Repeating components are not separately indicated in each figure.

DETAILED DESCRIPTION OF THE INVENTION

Figure 1:
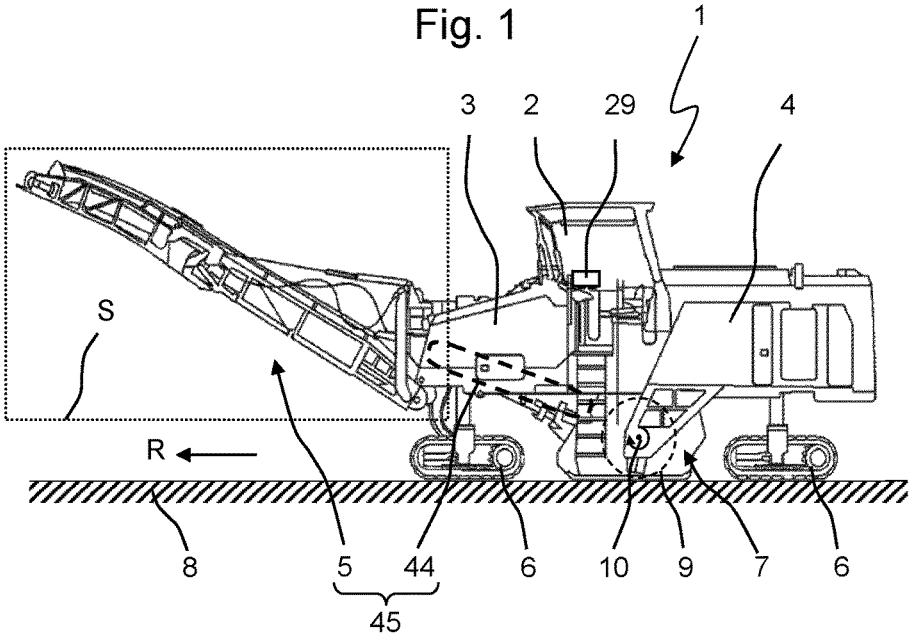
FIG. 1 is a side view of a ground milling machine.
Figure 2:
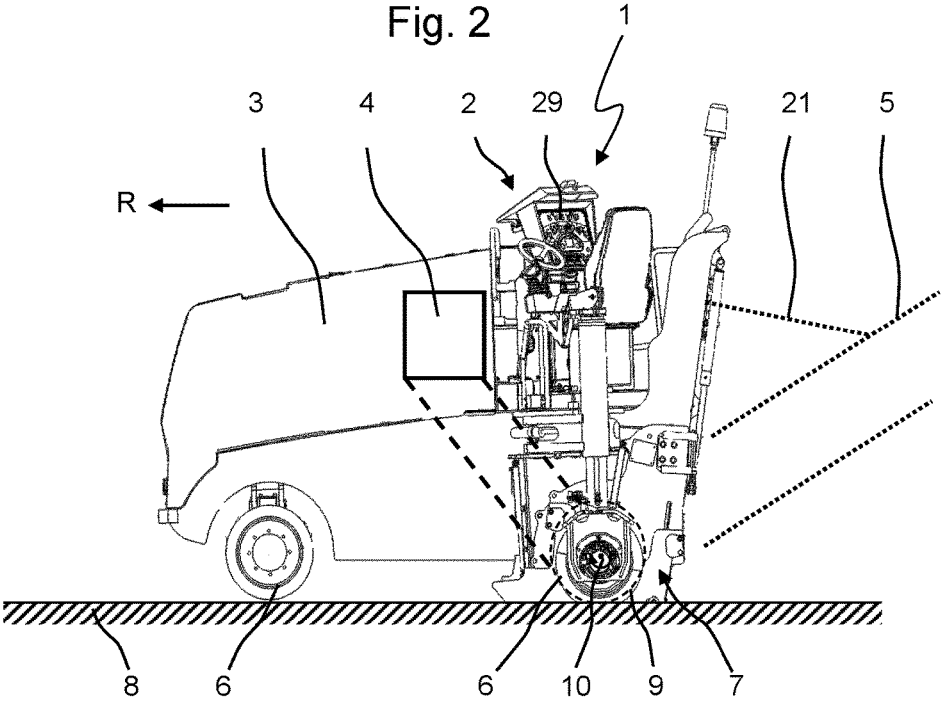
FIG. 2 is a side view of another ground milling machine.

A generic ground milling machine 1, specifically a road cold milling machine of the central rotor type, is shown in FIG. 1 in a side view. A similar view of another ground milling machine 1 configured as road cold milling machine, here of the rear rotor type, in shown in FIG. 2. The respective self-propelled ground milling machine 1 comprises an operator platform 2, a machine frame 3 and a milling drum 9 rotatably mounted in a milling drum box 7 so it is capable of rotating about an axis of rotation 10. The milling drum 9 as well as the tracks 6 are driven by the internal combustion engine 4 of the ground milling machine 1. During working operation of the ground milling machine 1, said machine moves in the working direction R and mills off the ground 8 along a milling track. The milled material is transferred via a conveyor device 45, in FIG. 1 specifically a discharge belt 5 and an input belt 44, to a transport vehicle, which is not shown here, and is transported away by said vehicle. The conveyor device 45 of the ground milling machine 1 of FIG. 2 merely comprises the discharge belt 5.

Figure 3:
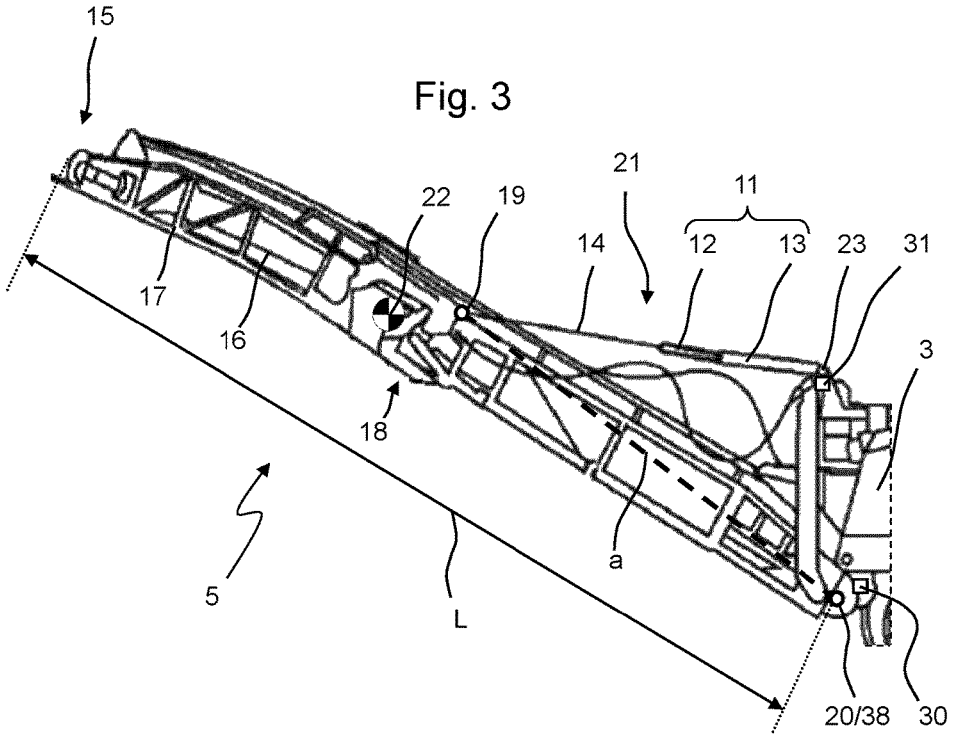
FIG. 3 is a detailed view of the discharge belt of the ground milling machine of FIG. 1.

The discharge belt 5 is shown in an enlarged view in FIG. 3, which shows the detail S of FIG. 1. In the context of the present description, the term "discharge belt" shall refer to the conveyor belt together with fixing equipment shown in FIG. 3 in an enlarged view. Furthermore, the ground milling machine 1 may comprise further conveyor devices, particularly conveyor belts, for example, internal conveyor devices for transferring the milled material from the milling drum box onto the discharge belt 5. However, such additional conveyor devices are not included in the term "discharge belt 5", which refers only to the suspension conveyor belt. The essential elements of the discharge belt 5 are a frame 17 in which a conveyor belt 16 is arranged, a joint 18, about which the discharge belt 5 may be folded in for transport, and a pivot bearing 20 via which it is supported on the machine frame 3 of the ground milling machine 1. Via the pivot bearing 20, the discharge belt 5 is pivotable about an axis 38 extending horizontally and transversely to the working direction R. Further, the discharge belt can also be pivoted about a vertical axis, which however is not shown in FIG. 3 for reasons of clarity.

Further, the discharge belt 5 is linked to the machine frame 3 of the ground milling machine 1 via a tensile connection 21 in vertical direction above the pivot bearing 20. The tensile connection 21 consists of a connection 14 linked to the mount 19 on the discharge belt 5, which connection is connected to the rod 12 of a hydraulic cylinder 11. For example, connection 14 may be a steel cable, a chain or a rod. The cylinder 13 of the hydraulic cylinder 11 in turn is linked to the machine frame 3 of the ground milling machine 1 via the link 23. The hydraulic cylinder 11 can be used for pivoting the discharge belt 5 on the pivot bearing 20. This way, the discharge belt 5 may be supported steeper, for example, by a contraction of the hydraulic cylinder 11 and be supported more even on the machine frame 3 of the ground milling machine 1 by means of an extension of the hydraulic cylinder 11. On the whole, the tensile connection 21 and the pivot bearing 20 form a suspension for the discharge belt 5, the discharge belt 5 being supported so it is able to pivot about the horizontal axis 38 on the pivot bearing 20. The discharge belt 5 does thus not pivot toward the ground 8 following gravity only because the tensile connection 21 exerts a holding tensile force to the discharge belt 5 and thus maintains said belt in position.

Essential parameters for carrying out the method according to the present invention can particularly also be seen from FIG. 3. For example, one essential parameter is the distance between the mount 19 of the tensile connection 21 on the discharge belt 5 and the pivot bearing 20. In FIG. 3, said distance is shown by connection line a. The mount 19 of the tensile connection 21 is not disposed in the center of mass 22 of the discharge belt 5. The shown discharge belt 5 is used for calculating the mass of the milled material removed by the ground milling machine 1. Therefore, the transport length L of the discharge belt 5 refers to the distance covered by the milled material on the conveyor belt. Specifically, this is the distance between the input point of the milled material to the conveyor belt and the point of discharge. For a rough approximation, the distance indicated in FIG. 3 between the pivot bearing 20 and the discharge 15 of the discharge belt 5 can be considered to that end.

Figure 4:
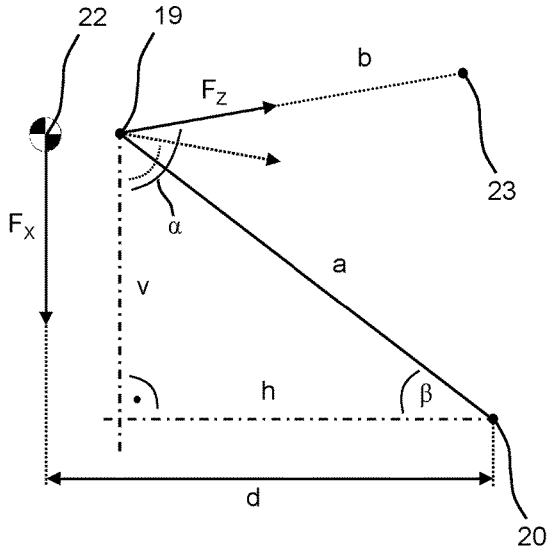
FIG. 4 is an outline of the parameters considered for calculation.

In order to describe the calculation according to the present invention of the mass of the milled material removed by the ground milling machine 1, the parameters considered for calculation are illustrated in FIG. 4 without the discharge belt 5 for reasons of clarity. $F_x$ refers to the overall weight, which—in a simplified illustration—acts from the center of mass 22 of the discharge belt 5 toward the ground 8. The distance of the center of mass 22 of the discharge belt 5 to the pivot bearing 20 projected into a horizontal plane is referred to as d. A virtual connection line a connects the pivot bearing 20 and the mount 19 on which the tensile connection 21 is linked to the discharge belt 5. The segment h extends in a horizontal plane from the pivot bearing 20 to an intersection with a vertical straight extending through the mount 19. The segment v extends in a vertical straight through the mount 19 to an intersection with the horizontal plane in which the segment h is located. Thus, the segments v and h are disposed perpendicular to one another and form a right-angled triangle together with the connection line a. The angle between connection line a and segment h is referred to as β. Connection line b connects the mount 19 of the tensile connection 21 on the discharge belt 5 to the link 23 of the tensile connection 21 on the ground milling machine 1. The indicated force $F_z$ is the tensile force which is to be exerted to the discharge belt 5 by the tensile connection 21 on the mount 19 in order to maintain the discharge belt 5 in its position. The tensile force $F_z$ extends along the connection line b or along the tensile connection 21. The angle between segment v or a vertical straight through mount 19 and the tensile force $f_z$ or the connection line b is referred to as a. Depending on where the link 23 of the tensile connection 21 is effected on the ground milling machine 1, the direction of the connection line b or of the tensile force $F_z$ changes. The exact location of the link 23 on the ground milling machine 1 is constructionally predetermined by the respective ground milling machine 1. However, the calculation as described below may be performed independent of the specific link 23 of the ground milling machine 1. However, it is preferred if the angle α during operation of the ground milling machine is greater than 90°, since the tensile force $F_z$ then being applied to the tensile connection 21 is less then with an angle α being smaller than 90°. An alternative orientation of the tensile connection 21 and thus the direction of the tensile force $F_z$ is indicated in FIG. 4 by the dotted arrow.

Now, the basic idea of the present invention is that the torque $D_x$ of the discharge belt 5 on the pivot bearing 20, which is caused by the weight $F_x$ of the discharge belt 5, is to be as great as the torque $D_z$ caused by the tensile force $F_z$ to the discharge belt 5 at the pivot bearing 20. Since the dimensions of the discharge belt 5 and of the suspension of the discharge belt 5 on the ground milling machine 1 are known and constant, respectively angles α and β at the round milling machine 1 can be measured or calculated, a dependency between the weight $F_x$ and the tensile force $F_z$ can be achieved by equalizing the respective torques. If the tensile force $F_z$ is measured, the weight $F_x$ can be calculated therefrom.

For the torque $D_x$ of the discharge belt 5 on the pivot bearing 20 caused on the center of mass 22 by the gravitational force $F_x$ applies:

$$D_x = F_x \cdot d \tag{1}$$

Here, it is omitted that the weight $F_x$ does not act perpendicularly on the discharge belt 5, but acts at an angle on the center of mass. However, this simplification leads to only a slight deviation which is within the measuring inaccuracy of the force measurement of the tensile force $F_z$. The deviation is so small that it is negligible for the present application. Of course the torque $D_x$ may also be calculated in consideration of the angle at which the weight $F_x$ acts on the discharge belt 5. Thus, calculation of the torque $D_x$ in consideration of said angle is also included in the scope of the present invention.

Torque $D_z$ caused by the effect of the tensile force $F_z$ to the discharge belt 5 at the pivot bearing 20 may be calculated in the present case by summation of two torques, each acting on a virtual horizontal or vertical lever. It applies:

$$\begin{aligned} D_Z &= a \cdot \sin\beta \cdot F_Z \cdot \cos(\alpha - 90°) + a \cdot \cos\beta \cdot F_Z \cdot \sin(\alpha - 90°) \\ &= a \cdot F_Z \cdot \sin(\alpha + \beta - 90°) \end{aligned} \tag{2}$$

As a result of the fact that the discharge belt 5 is maintained in position by the tensile connection 21, it applies:

$$D_x = D_z \tag{3}$$

By inserting formulas (1) and (2) into (3) followed by transposing the variables, a formula for the weight $F_x$ of the discharge belt 5 is achieved. If the weight $F_x$ of the discharge belt 5 with empty discharge belt 5, i.e., without milled material is known, said weight can be subtracted from the calculated value for $F_x$ for a discharge belt 5 loaded with milled material. Thereby the weight of the milled material located in the discharge belt 5 is obtained, which can easily be converted into the mass of the milled material.

The mass flow $q_m$ of the milled material on the discharge belt 5 can then be calculated from mass m of the milled material on the discharge belt 5, the overall length L of the discharge belt 5 and the conveying velocity V of the discharge belt 5 as follows:

$$q_m = m \cdot V/L \tag{4}$$

Since only the integrated value of the overall mass of the conveyed milled material is of interest for the final result, fluctuations of the conveyor belt 16 are not important for the calculation. The above described calculations are performed by the control device.

Figure 5:
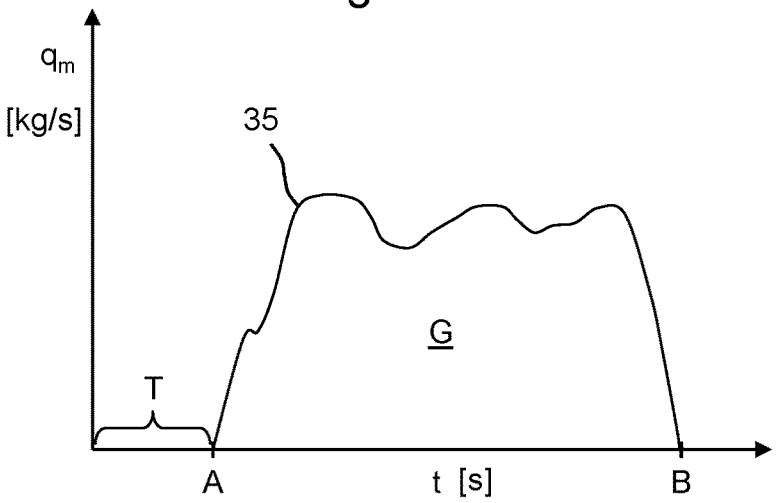
FIG. 5 is a diagram of the time course of the mass flow of the milled material on the discharge belt.

FIG. 5 shows a diagram of the time course of the mass flow $q_m$, for example, in kilogram per second, over the time t, for example, measured in seconds. The time A marks the start of the milling work or the start of conveying milled material on the discharge belt 5. The course of the curve 35 shows the increase, the time-dependent fluctuations and the decrease of the mass flow $q_m$ of the milled material on the discharge belt 5 from time A marking the start of conveying until time B marking the end of conveying. Milling work is finished at time B and the last remainder of milled material on the discharge belt 5 has been transferred from said belt onto the transport vehicle. That means that the discharge belt 5 is empty or free of milled material before time A and after time B. The time period T before time A is thus particularly suitable for determining a tare value of the empty discharge belt 5, which can then be subtracted from the calculated overall mass of the discharge belt 5 when calculating the mass of the milled material.

In order to calculate the area G, which stands for the entire conveyed mass of milled material between time A and time B, the mass flow $q_m$ is to be integrated by the control device over the time period between time A and time B. By the calculation according to the present invention, ultimately the mass of milled material is determined which has been conveyed by the discharge belt 5 in the time period observed. The observed time period may, for example, be the loading of a transport vehicle, the processing of a construction site, the executing of an order from a certain client or a daily performance.

Figure 6:
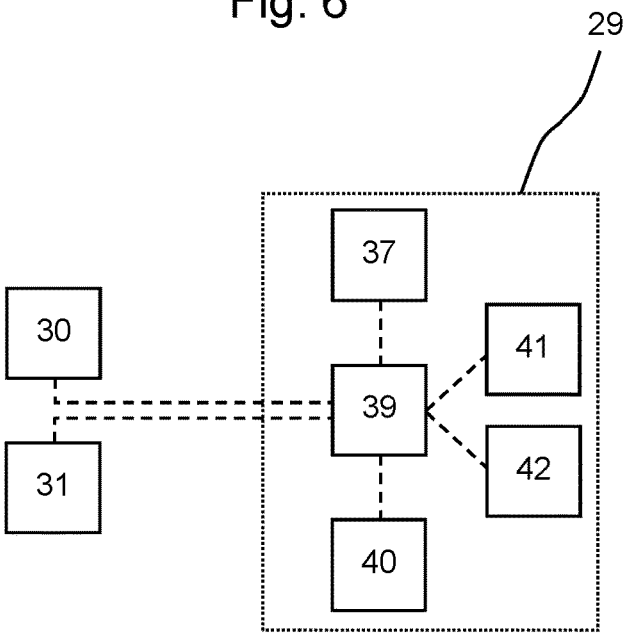
FIG. 6 shows a control device and sensors connected thereto.

A control device 29 according to the present invention for performing the method or for performing the calculation is shown in FIG. 6. The control device 29 comprises a central calculation device 39, for example, the board computer of the ground milling machine 1. The calculation device 39 is connected to the angle sensor 30 via signal connections, which sensor measures the angle α and/or the angle β and transmits the measured value to the calculation device 39. As an alternative, two angle sensors 30 could be provided, wherein in each case one of the sensors determines one of the angles α and β. Furthermore, the calculation device 39 is connected to a force sensor 31 measuring the tensile force $F_z$ on the tensile connection 21 and transmitting the measured result to the calculation device 39. For example, the force sensor 31 is configured as a force measuring bolt arranged on the link 23 of the tensile connection 21 on the machine frame 3 of the ground milling machine 1.

Further, the control device 29 comprises an input device 37 through which an operator may input threshold values, for example, which when reached shall trigger a warning signal to be output. Thus, the input device 37 is a functional unit through which information may be input for the control device. For example, this may be a keyboard, a QR-code reader or any other optoelectronic reader, a touchscreen, etc. In order to be able to output a warning signal, the control device 29 also comprises a warning device 42, which is capable of outputting optical and/or acoustic warning signals. In order to be able to inform the operator of the ground milling machine 1 of all parameters also during milling operation, the control device 29 also comprises a display device 41, on which all initial values, intermediate results and results of the measurements and calculations can be displayed. The display device 41 and the warning device 42 may also be formed in one piece. Furthermore, the control device 29 comprises a storage device 40, on which all measured values and/or calculated results and the associated time periods of the working operations of the ground milling machine can be stored. This way, the values may be read out from the storage device 40 for evaluation at a later time. All of the components named in FIG. 5 are connected to the calculation device 39 via signal connections. The signal connections may be wireless or wire-based connections. For example, it would be possible to connect the individual components to the calculation device 39 via a radio connection, for example, via WLAN. All of the options known from the prior art may be used for this.

In addition, the control device 29 is also connected to the ground milling machine 1 such that it may trigger controlling functions of the ground milling machine 1. This particularly includes influencing the tracks 6 of the ground milling machine 1 and/or stopping the rotation of the milling drum 9 of the ground milling machine 1. For example, the control device 29 is capable of reacting to a respective operating state of the ground milling machine 1. If the ground milling machine stops during operation, it does no longer mill-off ground material. However, the conveyor device 45 continues running so that after a certain period of time no milled material will be located on the conveyor belts, particularly on the discharge belt 5. In this case, the control device 29 may determine a new tare value and/or switch-off the conveyor device 45 or parts thereof in order to save energy, for example. For example, the control device 29 may also effect to switch-off the conveyor device 45 when the rotation of the milling drum is switched-off and the conveyor device 45 has continued to run until no more milled material is present on the conveyor device 45. This enables that the control device 29 automatically takes over tasks of the operator of the ground milling machine 1 during operation and thus reduces the workload of the operator. This also enables to automatically, and thus very rapidly, react to dangerous situations.

Figure 7:
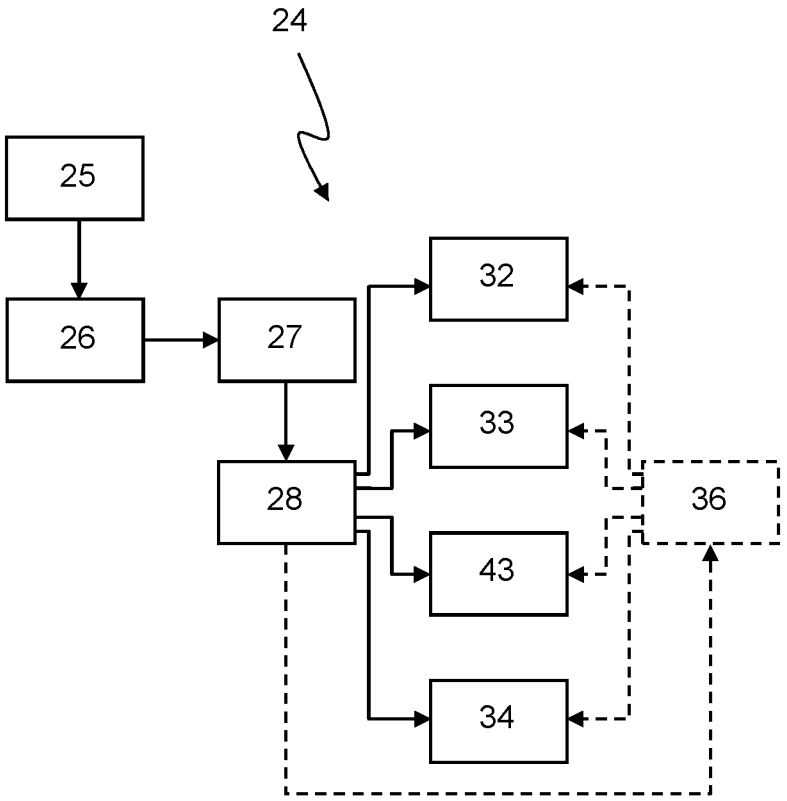
FIG. 7 is a flow chart of the method.

FIG. 7 is a flowchart of a method 24 according to the present invention. The method starts with the mounting 25 of the discharge belt 5 on the ground milling machine 1 according to the descriptions above. This is followed by determining 26 of the tensile force $F_z$ exerted by the discharge belt 5 on the tensile connection 21. This is followed by calculating 27 of the mass flow $q_m$ and calculating 28 the loaded mass of the milled material removed by the ground milling machine 1. Optionally, a comparison 36 of the calculated values, for example, to the maximum loading mass of the transport vehicle currently being loaded, and/or to the optimum loading mass of the conveyor belt 16 of the discharge belt 5, can be performed. Depending on the calculated values, a warning signal may be output 32 or the ground milling machine 1 may be controlled 34. As an alternative or in addition, the values are displayed 33 and stored 43.

By means of the present invention, a more accurate measurement of the mass of the removed milled material can be achieved than was possible in the prior art by means of belt weighers or the calculation of the volume. This facilitates the documentation of the milling works performed. The more accurate, continuous measurements enable a loading of the transport vehicles up to their maximum capacity and prevent overloading, whereby the cost-effectiveness of the milling work is enhanced. A collision between the discharge belt 5 and a transport vehicle is automatically detected. Monitoring the loading of the input belt 44 of the conveyor device 45 can reduce wear thereof, and an overloading of the milling drum box 7 is prevented in cases where the milling performance is too high.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A method for determining and monitoring a mass of milled material removed by a ground milling machine having a discharge belt pivotally mounted on the ground milling machine via a pivot bearing and a tensile connection such that the discharge belt is able to pivot at least about a horizontal axis, comprising:

determining a tensile force ($F_z$) exerted by the discharge belt to the tensile connection, calculating a mass flow ($q_m$) of the milled material removed by the ground milling machine from the determined tensile force ($F_z$), an overall length (L) and a conveying speed of the discharge belt, calculating a loaded mass of the milled material removed by the ground milling machine and transferred to a transport vehicle from the mass flow ($q_m$) and a loading time (t) of the milled material transferred to the transport vehicle, determining a milling width, a milling depth, and an advance of the ground milling machine, determining a volume of the milled material from the milling width, the milling depth, and the advance of the ground milling machine, determining a density of the milled material from the loaded mass and the volume of the milled material, and determining a volume of the milled material removed by the ground milling machine in a working operation from an overall loaded mass and the density of the milled material, or determining a current milling width from the loaded mass and the density of the milled material and a current milling depth and a current advance of the ground milling machine.

2. The method according to claim 1, wherein, for considering various pivoting positions of the discharge belt on the pivot bearing, an angle (β) between a horizontal straight (h) and a connection line (a) between a mount of the tensile connection on the discharge belt and the pivot bearing, and/or an angle (α) between a vertical straight (v) and a connection line (b) between the mount of the tensile connection on the discharge belt and a link of the tensile connection on the ground milling machine is measured, based on which the loaded mass of the milled material removed by the ground milling machine is calculated.

3. The method according to claim 1, wherein, in the case of an empty discharge belt, a tare value is determined, based on which the loaded mass of the milled material removed by the ground milling machine is calculated.

4. The method according to claim 1, wherein, during a loading process, a comparison between a currently determined loaded mass of the milled material removed by the ground milling machine and a maximum loading mass capacity of the transport vehicle and/or a predetermined threshold value is performed.

5. The method according to claim 4, wherein a loading stop function is provided such that when the maximum loading mass capacity of the transport vehicle and/or the predetermined threshold value is reached, an optical and/or acoustic warning signal is output and/or the ground milling machine is controlled.

6. The method according to claim 1, wherein a documentation function is provided by means of which an overall mass, a density and/or the volume of the milled material removed by the ground milling machine during a working operation and/or an area milled off during a working operation is displayed and/or stored.

7. The method according to claim 1, wherein a control of the ground milling machine is performed by a process monitoring function such that, depending on a mass of the milled material on the discharge belt, a milling performance of the ground milling machine and/or the speed of an input belt is controlled.

8. The method according to claim 1, wherein a safety function is provided, through which an output of an optical and/or acoustic warning signal is effected when the determined tensile force ($F_z$) drops during operation of the ground milling device, whereby a collision of the discharge belt with an obstacle is indicated.

9. A ground milling machine for milling-off ground material, comprising:

a drive engine;

a milling drum mounted in a milling drum box so that the milling drum is rotatable about an axis of rotation; and a discharge belt for loading milled material, which is mounted on the ground milling machine via a pivot bearing and a tensile connection fixed to the discharge belt such that the discharge belt can pivot at least about a horizontal axis, wherein the ground milling machine comprises a control device, the ground milling machine with the control device being configured to carry out the method steps according to claim 1.

10. The ground milling machine according to claim 9, wherein the tensile connection comprises a force sensor which is connected to the control device via a signal connection which transmits the tensile force ($F_z$) measured by the force sensor.

11. The ground milling machine according to claim 9, wherein said machine comprises an angle sensor, which measures an angle (β) between a horizontal straight (h) and a connection line (a) between a mount of the tensile connection on the discharge belt and the pivot bearing, and/or an angle (α) between a vertical straight (v) and a connection line (b) between the mount of the tensile connection on the discharge belt and a link of the tensile connection on the ground milling machine, and which is connected to the control device via a signal connection which transmits the angles (α, β) measured by the angle sensor.

12. The ground milling machine according to claim 9, wherein the control device comprises a warning device configured to output optical and/or acoustic warning signals.

13. The ground milling machine according to claim 9, wherein the control device comprises a display device and/or a storage device configured to display and/or store the determined tensile force ($F_z$) and/or an angle (α, β) and/or the calculated loaded mass and/or the volume and/or a density of the milled material removed by the ground milling machine and/or an area milled-off.

14. The ground milling machine according to claim 9, wherein the control device comprises an input device via which an operator may input threshold values for comparison with the loaded mass of milled material removed by the ground milling machine.

15. The ground milling machine according to claim 9, wherein the ground milling machine comprises one of a road milling machine, a recycler or a surface miner.

* * * * *